US009728155B2

(12) United States Patent
Koo

(10) Patent No.: US 9,728,155 B2
(45) Date of Patent: Aug. 8, 2017

(54) GAMMA SWITCHING AMPLIFIER

(75) Inventor: Ronald Bonshaw Koo, Los Altos, CA (US)

(73) Assignee: Maxim Integrated Products, Inc., San Jose, CA (US)

( * ) Notice: Subject to any disclaimer, the term of this patent is extended or adjusted under 35 U.S.C. 154(b) by 143 days.

(21) Appl. No.: 13/365,082

(22) Filed: Feb. 2, 2012

(65) Prior Publication Data

US 2012/0218319 A1 Aug. 30, 2012

Related U.S. Application Data

(60) Provisional application No. 61/446,703, filed on Feb. 25, 2011, provisional application No. 61/446,680, filed on Feb. 25, 2011, provisional application No. 61/446,662, filed on Feb. 25, 2011.

(51) Int. Cl.
*G09G 3/36* (2006.01)

(52) U.S. Cl.
CPC ... *G09G 3/3696* (2013.01); *G09G 2310/0291* (2013.01); *G09G 2320/0276* (2013.01); *G09G 2330/021* (2013.01)

(58) Field of Classification Search
CPC ..... G09G 3/3696; G09G 2330/021; G09G 2320/0276; G09G 2310/0291
See application file for complete search history.

(56) References Cited

U.S. PATENT DOCUMENTS 3,577,031 A * 5/1971 Welsh ..... H04N 9/28 315/14
5,206,912 A * 4/1993 Noro ..... H04R 3/002 381/59
5,349,389 A * 9/1994 Keller ..... H04N 9/69 348/625
6,552,606 B1 * 4/2003 Veltman ..... H03F 3/2171 330/10
2009/0096818 A1 * 4/2009 Nishimura et al. ..... 345/690
2009/0244109 A1 * 10/2009 Chen ..... G09G 3/3648 345/690
2011/0134152 A1 * 6/2011 Furihata ..... G09G 3/3648 345/690
2011/0187757 A1 * 8/2011 Yang et al. ..... 345/690

* cited by examiner

*Primary Examiner* — Lisa Landis
(74) *Attorney, Agent, or Firm* — TIPS Group

(57) ABSTRACT

Electronic devices with displays are configured to provide a gamma correction signal to each source driver chip driving the display. The gamma correction signal is supplied by a gamma application circuit coupled to each source driver chip. The gamma application circuit includes a switching amplifier configured to output a switching waveform and a filter to input the switching waveform and output the gamma correction signal to an input of each source driver chip. The switching amplifier functions as a switching power supply having improved power efficiency compared to conventional gamma application circuits.

9 Claims, 4 Drawing Sheets

GAMMA SWITCHING AMPLIFIER

PRIORITY CLAIM

This application claims priority under 35 U.S.C. §119(e) of the U.S. provisional patent application Ser. No. 61/446,703, filed Feb. 25, 2011, and titled "GAMMA SWITCHING AMPLIFIER," which is hereby incorporated by reference. This application also claims priority under 35 U.S.C. §119 (e) of the U.S. provisional patent application Ser. No. 61/446,662, filed Feb. 25, 2011, and titled "VCOM SWITCHING AMPLIFIER," which is hereby incorporated by reference. This application also claims priority under 35 U.S.C. §119(e) of the U.S. provisional patent application Ser. No. 61/446,680, filed Feb. 25, 2011, and titled "EMBEDDED GAMMA AND VCOM CALIBRATION FOR A DISPLAY," which is hereby incorporated by reference.

FIELD OF THE INVENTION

This invention relates to displays for electronic devices. More specifically, this invention relates to amplifiers used to provide a gamma setting voltage to a display panel used in liquid crystal displays.

BACKGROUND OF THE INVENTION

Displays are used on notebook PCs, televisions, and other electronic devices. Like most electronic devices, displays must be calibrated to accurately display video and graphic images. For example, the gamma response of a display is calibrated for optimum viewing and operation. Without proper calibration, the image on the display can be different from the original image captured by a camera.

A "gamma transfer" function characterizes the relationship between the light captured by a camera and the corresponding pixel voltages. FIG. 1A is a graph 20 of one such relationship, $V=L_{IN}^{1/\gamma}$ for $\gamma\approx2$. Such a gamma transfer function is exemplary of the light captured by a vacuum-tube camera. When rendering an image from these voltages, the display equipment must account for this non-linear relationship. Television cathode ray tubes (CRTs) have a gamma transfer function almost the inverse of the gamma transfer function of the vacuum-tube camera. When a CRT displays a video image captured from a vacuum-tube camera, the gamma transfer function of the CRT display essentially cancels the response of the vacuum-tube camera gamma transfer function. FIG. 1B is a graph 30 of one such relationship for a CRT display, where $L_{OUT}=V^{\gamma}$ for $\gamma\approx2$. The CRT's "gamma correction" is thus inherent, requiring little, if any, additional processing to accurately display video images. In other words, a video image captured by a camera with the response graph 20 and then displayed by the CRT with the response graph 30 will have a substantially linear output.

Other types of displays, such as liquid crystal displays (LCDs), however, have transfer characteristics different from CRTs and therefore need different gamma correction to accurately display video images. FIG. 2 is a graph 40 of one such relationship. Because displays differ, by manufacturer, by part number, and even by individual panel, each requires it own gamma correction so that the display achieves a linear response, or any other desired response.

Gamma correction is provided as a gamma correction signal supplied to source driver chips that drive the display. The gamma correction signal is supplied using an appropriate gamma application circuit. During the assembly of a conventional display panel, the gamma correction signal can be calibrated by electronically adjusting parameters associated with the gamma application circuit. In some processes, a technician views a test image on the display and manually adjusts the gamma application circuit through empirical trial and error until the image is properly displayed. In other processes, the gamma correction signal calibration can be performed by monitoring the display panel and inputting detected display characteristics into a software algorithm to determine the proper gamma correction signal. The determined proper gamma correction signal is then set by the gamma application circuit. The proper gamma correction signal is then stored in non-volatile storage or set by a resistor string on the display controller board for the life of the display.

Conventional gamma application circuits use a Class AB amplifier to generate the proper gamma correction signal that is provided to source driver chips. FIG. 3 illustrates an exemplary conventional gamma application circuit 10. A digital-to-analog converter (DAC) 2 receives as input a digital code representative of the proper gamma correction signal stored in memory. The DAC 2 outputs a converted analog signal to a first input of an amplifier 4. The amplifier 4 is a Class AB operational amplifier. A second input of the amplifier 4 is a feedback signal. The amplifier 4 is supplied with an analog power supply voltage AVDD. An output of the amplifier 4 is the gamma correction signal that is supplied to each of one or more source driver chips 6. The source driver input impedance can be modeled as an equivalent resistance and as a capacitance to AC ground.

The gamma correction signal is substantially constant. The gamma application circuit 10 includes a local feedback from the output of the Class AB amplifier 4 to the second input of the Class AB amplifier 4.

The gamma correction signal distorts the gamma transfer function of the source driver chip to correct for the non-linear behavior of the display. Distorting the gamma transfer function of the source driver chip adjusts the response of the display. In some applications, the display response is adjusted to achieve a linear transfer function.

The output stage of a typical Class AB amplifier includes two complimentary transistors configured for sourcing and sinking current. The transistors in a Class AB amplifier operate in the linear mode. The power efficiency of the output stage of the typical Class AB amplifier is at best 50%.

SUMMARY OF THE INVENTION

In accordance with the principles of the invention, electronic devices with displays are configured to provide a gamma correction signal to each source driver chip driving the display. The gamma correction signal is supplied by a gamma application circuit coupled to each source driver chip. The gamma application circuit includes a switching amplifier configured to output the gamma correction signal and an optional filter coupled between an output of the switching amplifier and an input of each source driver chip. The switching amplifier functions as a switching power supply having improved power efficiency compared to conventional gamma application circuits.

In one aspect, an electronic device for driving a display having one or more source driver chips is disclosed. The electronic device includes a gamma application circuit coupled to the one or more source driver chips to supply each of the one or more source driver chips with a gamma correction signal, wherein the gamma application circuit comprises a switching amplifier configured to output a switching waveform used to form the gamma correction signal. In some embodiments, the display is a liquid crystal display. In some embodiments, the switching amplifier is coupled to an analog voltage power supply. In some embodiments, a voltage range output from the switching amplifier is between about 200 mV and within 200 mV of the analog voltage power supply. In other embodiments, a voltage range output from the switching amplifier is between about 100 mV and within 100 mV of the analog voltage power supply. In still other embodiments, a voltage range output from the switching amplifier is between about 10 mV and within 10 mV of the analog voltage power supply. In some embodiments, the switching amplifier is a Class D amplifier. In some embodiments, a power efficiency of the switching amplifier is equal to or greater than 80%. In some embodiments, the electronic device also includes a filter coupled between the switching amplifier and the one or more source driver chips. In this embodiment, the gamma application circuit can also include an inductor, wherein the filter includes the inductor and a capacitance of the one or more source driver chips. In this embodiment, the electronic device can also include a capacitor, wherein the filter also includes the capacitor. In some embodiments, the electronic device can also include a control circuit coupled to the switching amplifier, wherein the control circuit is configured to control the switching amplifier so as to modulate a duty cycle of the switching waveform.

In another aspect, an electronic device for driving a display having one or more source driver chips is disclosed. The electronic device includes a gamma application circuit coupled to the one or more source driver chips to supply each of the one or more source driver chips with a gamma correction signal, wherein the gamma application circuit comprises a Class D switching amplifier configured to output a switching waveform and an inductor coupled to an output of the Class D amplifier and configured to receive the switching waveform and output the gamma correction signal.

In yet another aspect, a method of driving a display having one or more source driver chips is disclosed. The method includes using a switching amplifier to supply a switching waveform; forming a gamma correction signal from the switching waveform; and providing the gamma correction signal to the one or more source driver chips.

DETAILED DESCRIPTION OF THE EMBODIMENTS

Embodiments of the present application are directed to a gamma application circuit. Those of ordinary skill in the art will realize that the following detailed description of the gamma application circuit described herein is illustrative only and is not intended to be in any way limiting. Other embodiments of the gamma application circuit will readily suggest themselves to such skilled persons having the benefit of this disclosure.

Reference will now be made in detail to implementations of the gamma application circuit as illustrated in the accompanying drawings. The same reference indicators will be used throughout the drawings and the following detailed description to refer to the same or like parts. In the interest of clarity, not all of the routine features of the implementations described herein are shown and described. It will, of course, be appreciated that in the development of any such actual implementation, numerous implementation-specific decisions will likely be made in order to achieve the developer's specific goals, such as compliance with application and business related constraints, and that these specific goals can vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

In accordance with embodiments of the application, an electronic device with one or more source driver chips and a display is also configured with a gamma application circuit having a switching amplifier to supply a gamma correction signal to the source driver chips. In some embodiments, the switching amplifier is a Class D amplifier. An output stage of the switching amplifier includes a pair of complimentary transistors that are switched on and off such that the switching amplifier functions effectively as a switching power supply. A power efficiency of the switching amplifier is at least 80%, which is a significant improvement over the conventional gamma application circuit using a Class AB amplifier. If necessary, an inductor and a capacitance of each source driver chip filters the output signal of the switching amplifier. The inductor can be either a discrete, external inductor or an integrated inductor.

Figure 4:
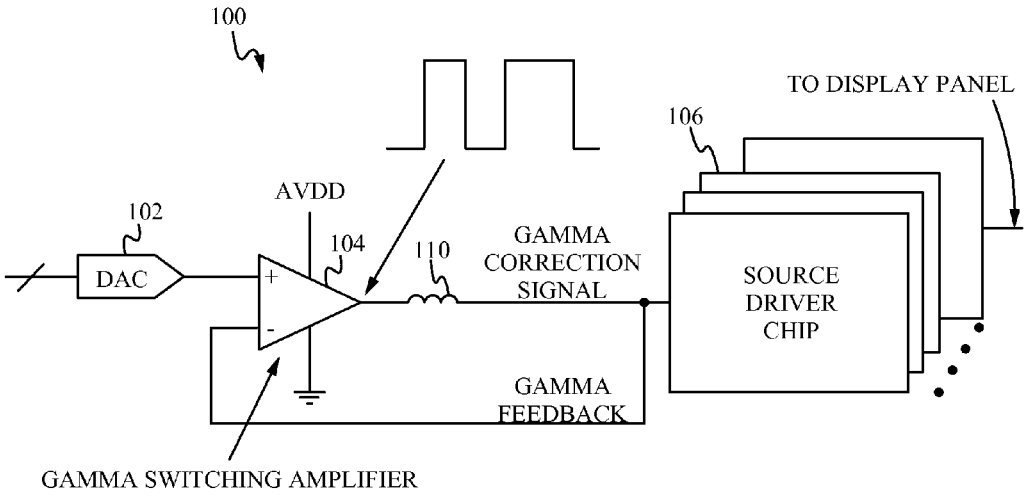
FIG. 4 illustrates a conceptual diagram of a gamma correction system including a gamma application circuit according to an embodiment of the present invention.

FIG. 4 illustrates a conceptual diagram of a gamma correction system including a gamma application circuit 100 according to an embodiment of the present invention. The gamma application circuit 100 includes a DAC 102, a switching operational amplifier 104, and an inductor 110. The gamma application circuit 100 is coupled to one or more source driver chips 106. The DAC 102 receives as input a digital code representative of the proper gamma correction signal stored in memory. The DAC 102 outputs a converted analog signal to a first input of the switching amplifier 104. A second input of the switching amplifier 104 is a feedback signal, referred to as the gamma feedback. The switching amplifier 104 is supplied with an analog power supply voltage AVDD. In some embodiments, the analog supply voltage AVDD has a maximum voltage in the range of about 8V to about 30V. The switching amplifier 104 functions as a switching power supply and therefore outputs a switching waveform, such as that shown in FIG. 4. The switching waveform output from the switching amplifier 104 is filtered resulting in the gamma correction signal that is supplied to each of one or more source driver chips 106. The filter includes the inductor 110 and the capacitance of the one or more source driver chips 106. In some embodiments, the gamma correction signal is substantially constant. There is an inherent parasitic capacitance within each source driver chip 106. The filter is designed to consider this parasitic capacitance. If the parasitic capacitance is insufficient to meet the design considerations for the filter, additional capacitance can be added to the gamma application circuit, such as coupling a capacitor to the inductor 110. Using a switching amplifier requires proper selection of the inductor 110 and any additional capacitance to provide necessary circuit stability and quickness of the transient response of the gamma correction signal output to the source driver chips in the case of a changing output load.

The source driver input impedance can be modeled as an equivalent resistance and as a capacitance to AC ground. In some applications, the transient output current from the switching amplifier is about 100 milliamps, where the transient output current occurs when a horizontal line of the display is refreshed. Although a single gamma application circuit 100 is shown in FIG. 4 coupled to each of the one or more source driver chips 106, alternative configurations are also contemplated in which multiple gamma application circuits are used. In the case of multiple gamma application circuits, each source driver chip receives the gamma correction signal output from each of the multiple gamma application circuits. For example, in a system having six source driver chips and sixteen gamma application circuits, the output of each of the sixteen gamma application circuits is coupled to each of the six source driver chips so that each source driver chip receives sixteen gamma correction signals. Additional gamma correction signals enable finer tuning of the display response.

Figure 5:
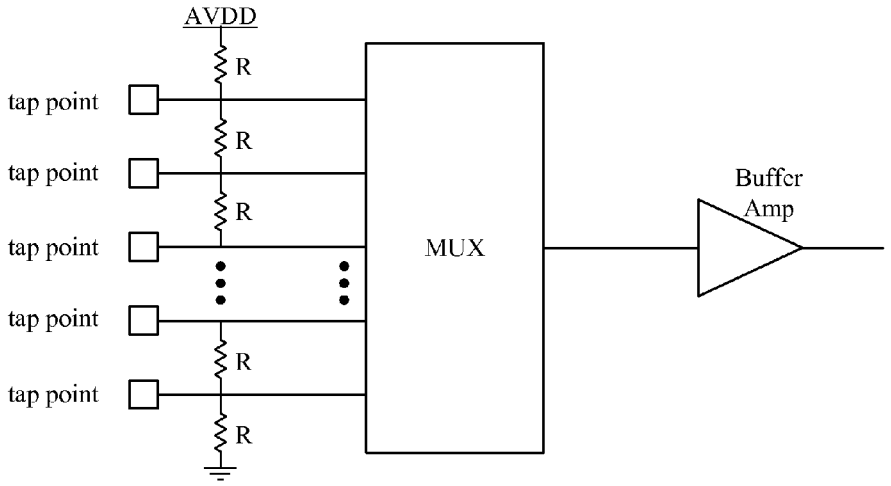
FIG. 5 illustrates a conceptual circuit diagram of an exemplary input stage of one of the source driver chips.

The load coupled to the gamma application circuit is a DC load that requires a DC current output from the gamma application circuit. FIG. 5 illustrates a conceptual circuit diagram of an exemplary input stage of one of the source driver chips 106. The input stage includes a digital-to-analog converter (DAC) followed by a buffering amplifier, which is repeated for each channel N of the source driver chip. In the exemplary circuit of FIG. 5, the DAC is implemented using a string of resistors R and a multiplexer. The resistor string is coupled to the analog supply voltage AVDD. In an exemplary application, an 8-bit DAC includes a resistor string having 256 resistors R. A plurality of tap points provide external control access to the resistor string. A tap point is coupled to each resistor R in the resistor string. An output of each resistor R is coupled to the multiplexor, which outputs one of the resistor voltage outputs to a buffer amplifier. In some embodiments, a discrete gamma application circuit is coupled to each of a select subset of tap points. In other embodiments, a discrete gamma application circuit is coupled to each tap point.

Figure 1A:
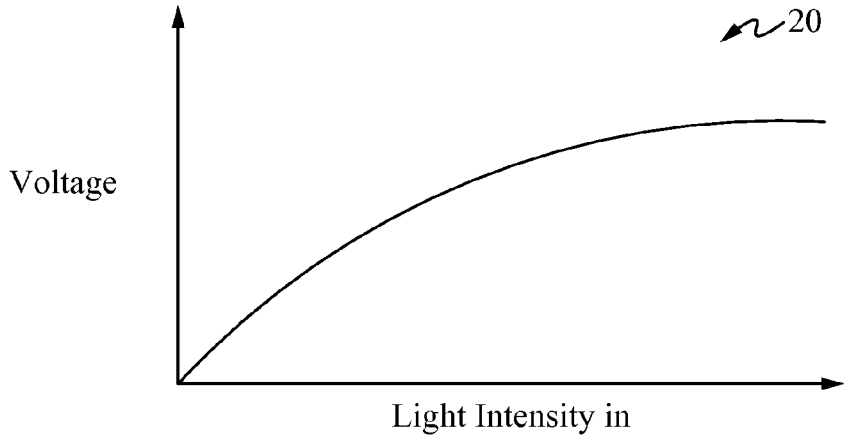
Fig. 1A (Prior Art)
FIGS. 1A and 1B are transfer functions of, respectively, a vacuum-tube camera and a cathode ray tube display.
Figure 1B:
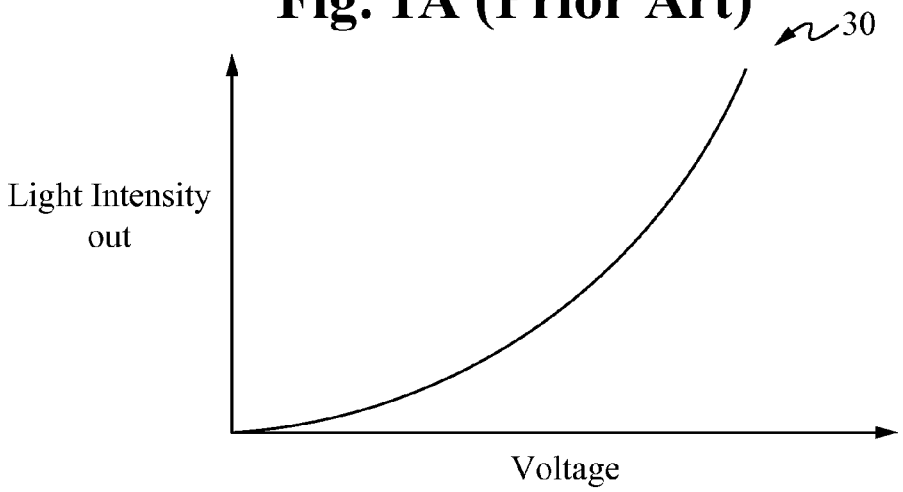
Fig. 1B (Prior Art)
Figure 2:
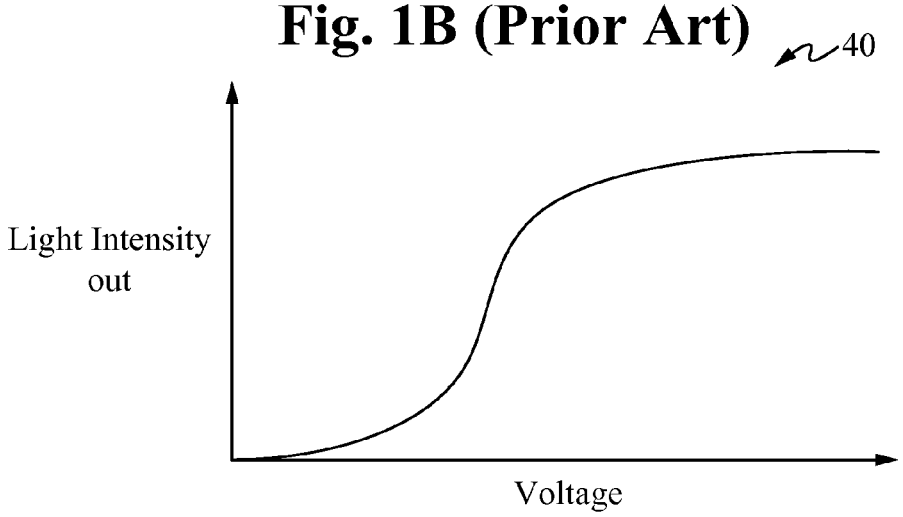
Fig. 2 (Prior Art)
FIG. 2 is a transfer function of a liquid crystal display.
Figure 3:
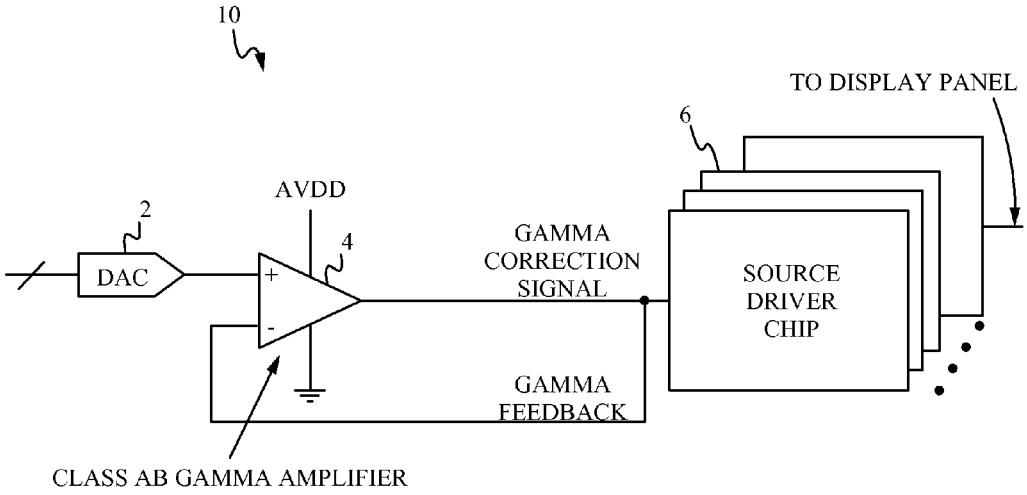
Fig. 3 (Prior Art)
FIG. 3 illustrates an exemplary conventional gamma application circuit.

When no control voltages are applied to the tap points, the transfer function for the resistor string is simply a straight line since each resistor R has the same value. Alternatively, the resistor string can include resistors having values that are not all the same. In this case, the transfer function may be non-linear when no control voltages are applied. If a different transfer function curve is desired, such as the transfer function curve of FIG. 2, the gamma application circuits supply appropriate control voltages to the corresponding tap points to generate the desired transfer function curve for the source driver chips. The voltages applied to the tap points are the gamma correction signals supplied by the gamma application circuits. In the exemplary system having six source driver chips and sixteen gamma application circuits, sixteen tap points are made available for external control, each of the sixteen tap points is coupled to one of the sixteen gamma application circuits.

Figure 6:
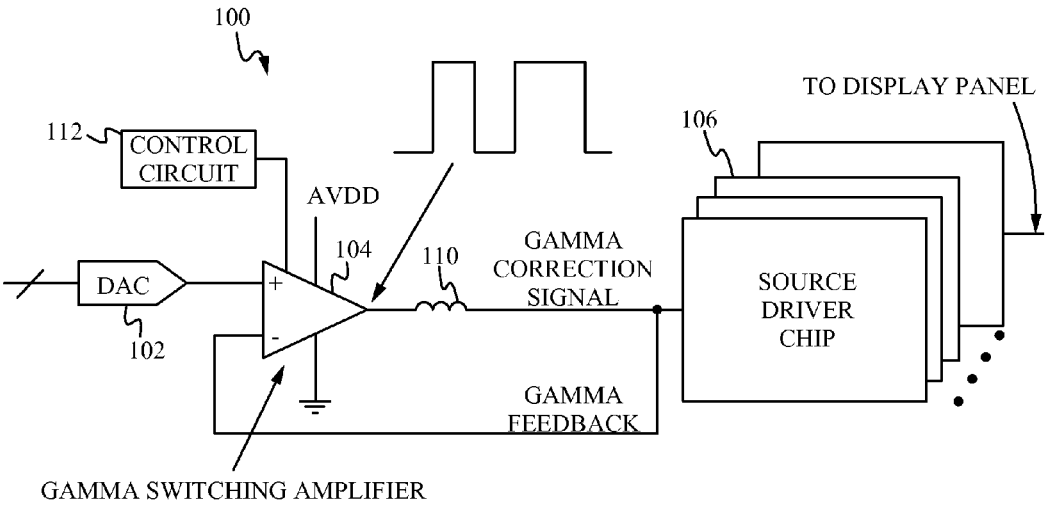
FIG. 6 illustrates the conceptual block diagram of FIG. 4 including a control circuit.

The switching amplifier 104 modulates the duty cycle of the square wave output to generate the desired voltage level. In some embodiments, a control circuit 112 is coupled to the switching amplifier 104, as shown in FIG. 6. The control circuit 112 is coupled to the switching amplifier 104 so as to modulate a duty cycle of the switching waveform.

In some embodiments, the voltage range output from the switching amplifier 104 is between about 200 mV and within 200 mV of the AVDD supply voltage. More preferably, the voltage range output from the switching amplifier 104 is between about 100 mV and within 100 mV of the AVDD supply voltage. Still more preferably, the voltage range output from the switching amplifier 104 is between about 10 mV and within 10 mV of the AVDD supply voltage.

Figure 7:
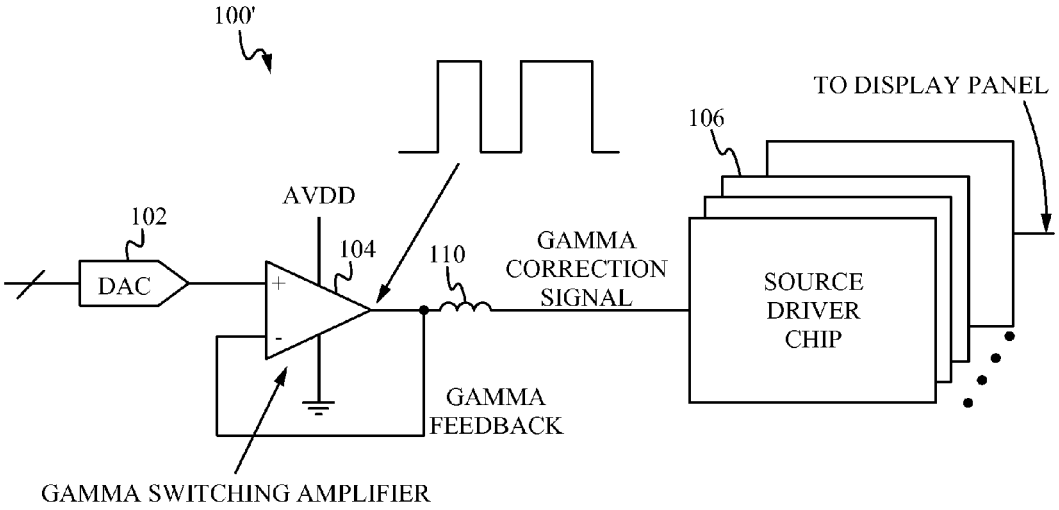
FIG. 7 illustrates a conceptual diagram of an alternative gamma correction system including a gamma application circuit according to another embodiment of the present invention.

An alternative configuration of a gamma application circuit 100' is shown in FIG. 7. The gamma application circuit 100' includes a local feedback directly from the output of the switching amplifier 104 to the second input of the switching amplifier 104.

An advantage of using a switching amplifier in the gamma application circuit is a significant improvement in the power efficiency when compared to conventional gamma application circuits using Class AB amplifiers. Especially when applied to displays requiring relatively high analog power supply levels, such as 8V to 30V, the improvement in power efficiency also leads to a significant reduction in heat generated by the gamma application circuit.

The present application has been described in terms of specific embodiments incorporating details to facilitate the understanding of the principles of construction and operation of the gamma application circuit. Many of the components shown and described in the various figures can be interchanged to achieve the results necessary, and this description should be read to encompass such interchange as well. As such, references herein to specific embodiments and details thereof are not intended to limit the scope of the claims appended hereto. It will be apparent to those skilled in the art that modifications can be made to the embodiments chosen for illustration without departing from the spirit and scope of the application.

I claim:

1. A liquid crystal display with gamma application circuit comprising:

a liquid crystal display having one or more source driver chips, wherein each source driver chip includes an input stage having a digital-to-analog converter (DAC) followed by a buffering amplifier; and a gamma application circuit coupled to the input stage of the one or more source driver chips with a discrete inductor to supply each of the one or more source driver chips with a gamma correction signal;

wherein the gamma application circuit comprises a capacitor coupled to the inductor, a switching Class D switching amplifier coupled to an analog voltage power supply and having a power efficiency equal to or greater than 80%, the Class D switching amplifier being configured as a switching power supply having a positive input, a negative input, and an output to output a switching waveform used to form the gamma correction signal and a gamma feedback signal coupled to the negative input, and a control circuit coupled to the Class D switching amplifier, wherein the control circuit is configured to control the Class D switching amplifier so as to modulate a duty cycle of the switching waveform.

2. The liquid crystal display with gamma application circuit of claim 1 wherein the DAC comprises a resistor string coupled to the analog voltage power supply and having a plurality of tap points to provide external control access to the resistor string, and a multiplexor having a plurality of inputs coupled to the plurality of tap points and an output coupled to the buffering amplifier, wherein a discrete gamma application circuit is coupled to all or a select subset of the tap points.

3. The liquid crystal display with gamma application circuit of claim 1 wherein a voltage range output from the switching amplifier is between 200 mV and a voltage of the analog voltage power supply minus 200 mV.

4. The liquid crystal display with gamma application circuit of claim 1 wherein a voltage range output from the switching amplifier is between 100 mV and a voltage of the analog voltage power supply minus 100 mV.

5. The liquid crystal display with gamma application circuit of claim 1 wherein a voltage range output from the switching amplifier is between 10 mV and a voltage of the analog voltage power supply minus 10 mV.

6. A liquid crystal display with gamma application circuit comprising:

a liquid crystal display having at least one source driver chip provided with an input stage comprising a digital-to-analog converter (DAC) followed by a buffering amplifier; and a gamma application circuit coupled to the source driver chip to supply the source driver chip with a gamma correction signal, wherein the gamma application circuit comprises a Class D switching amplifier with gamma feedback that is configured as a switching power supply with a positive input, a negative input, and an output to output a switching waveform comprising the gamma feedback coupled to the negative input, a discrete inductor coupled to the output of the Class D amplifier and configured to receive the switching waveform and output the gamma correction signal, a capacitor coupled to the inductor and a control circuit configured to control the Class D switching amplifier so as to modulate a duty cycle of the switching waveform;

wherein the Class D switching amplifier is coupled to an analog voltage power supply;

wherein a power efficiency of the Class D switching amplifier is equal to or greater than 80%; and wherein a voltage range output from the Class D switching amplifier is between 100 mV and a voltage of the analog voltage power supply minus 100 mV.

7. The liquid crystal display with gamma application circuit of claim 6 wherein the DAC comprises a resistor string coupled to the analog voltage power supply and having a plurality of tap points to provide external control access to the resistor string, and a multiplexor having a plurality of inputs coupled to the plurality of tap points and an output coupled to the buffering amplifier, wherein the gamma application circuit is coupled to all or a select subset of the tap points.

8. The liquid crystal display with gamma application circuit of claim 6 wherein a voltage range output from the Class D switching amplifier is between 10 mV and a voltage of the analog voltage power supply minus 10 mV.

9. A method of driving a liquid crystal display having one or more source driver chips, the method comprising:

a. using a Class D switching amplifier configured as a switching power supply with a positive input, a negative input, and an output, the Class D switching amplifier being separate from the display having the one or more source driver chips, the switching amplifier configured as a switching power supply to supply a switching waveform and having a gamma feedback coupled to the negative input;

b. electronically controlling the Class D switching amplifier to modulate a duty cycle of the switching waveform;

c. forming a gamma correction signal by filtering the switching waveform with a filter comprising a discrete inductor and a capacitor;

d. converting the gamma correction signal to an analog signal in an input stage of the one or more source driver chips; and e. buffering and amplifying the analog signal for gamma correction in the one or more source driver chips.

* * * * *